US011724510B2

(12) United States Patent
Devries

(10) Patent No.: US 11,724,510 B2
(45) Date of Patent: Aug. 15, 2023

(54) INTERFACES TO CONNECT EXTERNAL PRINT FLUID SUPPLIES WITH PRINT FLUID RESERVOIRS

(71) Applicant: Hewlett-Packard Development Company, L.P., Spring, TX (US)

(72) Inventor: Mark A. Devries, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 253 days.

(21) Appl. No.: 17/285,116

(22) PCT Filed: Dec. 12, 2018

(86) PCT No.: PCT/US2018/065264

§ 371 (c)(1),
(2) Date: Apr. 14, 2021

(87) PCT Pub. No.: WO2020/122903

PCT Pub. Date: Jun. 18, 2020

(65) Prior Publication Data

US 2021/0370684 A1 Dec. 2, 2021

(51) Int. Cl.
*B41J 2/175* (2006.01)

(52) U.S. Cl.
CPC ..... *B41J 2/17566* (2013.01); *B41J 2/17526* (2013.01); *B41J 2/17596* (2013.01)

(58) Field of Classification Search
CPC .... B41J 2/175; B41J 2/17503; B41J 2/17506; B41J 2/17509; B41J 2/17523; B41J 2/17526; B41J 2/17546; B41J 2/17566; B41J 2/17596; B41J 2/195; B41J 2/20; B41J 2002/17569
See application file for complete search history.

(56) References Cited

U.S. PATENT DOCUMENTS

| | | | | |
|---|---|---|---|---|
| 4,183,029 | A | 1/1980 | Isayama | |
| 4,337,468 | A | 6/1982 | Mizuno | |
| 4,827,280 | A | 5/1989 | Stamer et al. | |
| 5,473,350 | A | 12/1995 | Mader et al. | |
| 6,089,687 | A * | 7/2000 | Helterline | B41J 2/17546 347/7 |
| 6,345,891 | B1 * | 2/2002 | Childers | B41J 2/17546 347/19 |
| 7,992,960 | B2 | 8/2011 | Brister et al. | |
| 9,524,132 | B2 | 12/2016 | Weaver et al. | |
| 2002/0113850 | A1 | 8/2002 | Wheeler et al. | |
| 2003/0160837 | A1 | 8/2003 | Adkins et al. | |
| 2012/0001968 | A1 | 1/2012 | Inoue et al. | |
| 2016/0347074 | A1 | 12/2016 | Ribeiro et al. | |
| 2017/0144448 | A1 | 5/2017 | Smith | |

FOREIGN PATENT DOCUMENTS

| | | |
|---|---|---|
| CN | 102310650 | 1/2012 |
| CN | 106183429 | 12/2016 |
| CN | 10700435 | 8/2017 |

(Continued)

*Primary Examiner* — Anh T Vo

(74) *Attorney, Agent, or Firm* — Brooks, Cameron & Huebsch, PLLC

(57) ABSTRACT

An apparatus may include an electrical interface to access a memory. Based on data receivable from the memory, an actuator may allow fluid flow from a print fluid supply external to the apparatus to a print fluid reservoir of the apparatus.

15 Claims, 3 Drawing Sheets

(56) References Cited

FOREIGN PATENT DOCUMENTS

| | | | |
|---|---|---|---|
| CN | 108472954 | | 8/2018 |
| DE | 10332225 | B4 | 7/2005 |
| EP | 0720916 | A2 | 7/1996 |
| EP | 1329322 | B1 | 6/2005 |
| EP | 3098075 | B1 | 6/2019 |
| WO | 9965695 | | 12/1999 |
| WO | 9965698 | | 12/1999 |

* cited by examiner

INTERFACES TO CONNECT EXTERNAL PRINT FLUID SUPPLIES WITH PRINT FLUID RESERVOIRS

BACKGROUND

Printers may have refillable internal print fluid reservoirs. The internal print fluid reservoirs may be refilled from external print fluid supplies. The printer may include an interface for refilling the internal print fluid reservoir from the external print fluid supply.

BRIEF DESCRIPTION OF THE DRAWINGS

Various examples will be described below referring to the following figures.

DETAILED DESCRIPTION

Print fluid supplies may be subject to depletion, such as through the evaporation of water over time. Refilling a printer's print fluid reservoir with depleted print fluid may cause print quality issues or damage to the printer. As the amount of print fluid in the print fluid supply decreases, the depletion rate may increase. Thus, once a print fluid supply has been substantially used, it may become depleted more quickly. The issue of print fluid depletion for print fluid supplies used to refill print fluid reservoirs may be more pronounced than print fluid depletion from print fluid reservoirs, as print fluid from the print fluid reservoirs may be used more often. A print fluid supply may sit on a shelf for months with a low print fluid level before being used to refill a print fluid reservoir, while print fluid in a print fluid reservoir may be more likely to be used up before depletion becomes an issue. It may not be readily apparent by visibly inspecting the print fluid whether the print fluid supply has become too depleted. As depletion may vary over time with print fluid levels, a general expiration date for the print fluid supply may not be very accurate. Users may be faced with a tradeoff between potentially throwing away usable print fluid or causing print issues by using print fluid that has become too depleted.

Risks for this tradeoff may be lessened by placing a memory on the print fluid supply container to track print fluid usage. When the print fluid supply is used to refill the printer's internal print fluid reservoir, the memory may be accessed. Data regarding the print fluid supply's use may be analyzed to determine a quality of the print fluid, such as an estimated level of depletion. The printer may determine whether to pump print fluid from the print fluid supply to the printer's internal print fluid reservoir based on the print fluid quality. The memory may allow tracking of use of the print fluid over time and calculating the depletion of the print fluid based on the amount of print fluid remaining in the print fluid supply and how long it has been since the last use. The printer may thus determine whether the print fluid from the print fluid supply is likely to cause issues and should be thrown away, or whether it may still be safely used. This may lead to less wasted print fluid and fewer maintenance issues for the printer.

Figure 1:
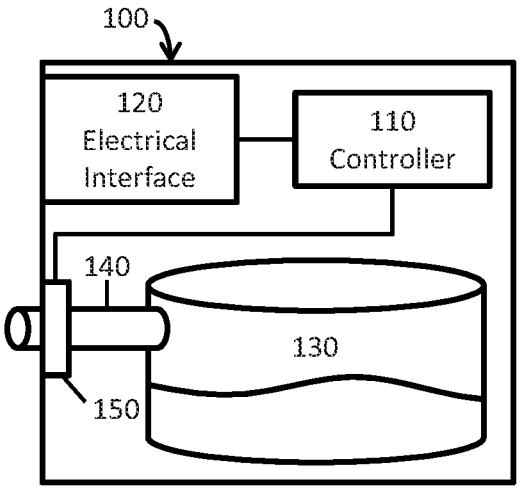
FIG. 1 depicts a printer with an electrical interface and an actuator in accordance with various examples.

FIG. 1 shows a printer 100 with an electrical interface 120 and an actuator 150 in accordance with various examples. The printer 100 includes a controller 110, an electrical interface 120, a print fluid reservoir 130, a fluid conduit 140, and an actuator 150.

The controller 110 may be coupled to the electrical interface 120, such as via a bus. The controller 110 may be coupled to the actuator 150, such as via a bus or a control line. The controller 110 may comprise a microprocessor, a microcomputer, a microcontroller, a field programmable gate array (FPGA), or discrete logic. The controller 110 may execute machine-readable instructions that implement the methods described herein, such as the method described in connection with FIG. 3.

The electrical interface 120 may be used to access a memory external to the printer 100. The electrical interface 120 may include contact points for passing electrical signals between the electrical interface 120 and the memory. The controller 110 may access the memory via the electrical interface 120, such as for reading or writing to the memory. The memory may be a memory chip or other appropriate storage. The memory may be a read-only memory or allow for reading from and writing to the memory.

The print fluid reservoir 130 may contain a quantity of print fluid for use by the printer 100. The print fluid reservoir 130 may be a refillable print fluid reservoir. The print fluid reservoir 130 may be connected to the fluid conduit 140 for refilling the print fluid reservoir 130. The fluid conduit 140 may be connectable to an external print fluid supply to refill the print fluid reservoir 130. An actuator 150 may control the flow of print fluid from the external print fluid supply and through the fluid conduit 140 into the print fluid reservoir 130. The actuator 150 may comprise an electrically controlled pump, a solenoid valve, or controlled insertion of the fluid conduit 140 into the external print fluid supply. The actuator 150 may include a needle that punctures a resealable septum of the external print fluid supply. Puncturing the septum may allow print fluid to flow through the fluid conduit 140. The print fluid may flow through the fluid conduit 140 due to being pumped or due to another force, such as by gravity or pressure differences. The controller 110 may control the actuator 150 to selectively allow the flow of print fluid through the fluid conduit 140. The external print fluid supply may include a memory that couples to the electrical interface 120. The print fluid may include ink, such as is used with an inkjet printer, a liquid used in three-dimensional printing, or other fluids used in printing on surfaces or in three dimensions.

The controller 110 may read data from the memory via the electrical interface 120. The data may include information about the use and history of the print fluid supply. In various examples, the data may include a record of when the print fluid supply was manufactured, the addition or removal of print fluid or other substances from the print fluid supply, a print fluid type, a print fluid failure threshold, or a water loss rate characteristic. The print fluid failure threshold may indicate a recommended maximum depletion level of the print fluid. The water loss rate characteristic may be used in calculating the depletion of water from the print fluid over time. Records regarding the addition or removal of print fluid from the print fluid supply may include an indication of when the addition or removal occurred, such as via a timestamp. The data may indicate how much print fluid was removed or added to the print fluid supply. The controller 110 may use the data to estimate an amount of print fluid present in the print fluid supply. In various examples, the data may be aggregated to indicate an estimated amount of print fluid present in the print fluid supply, rather than the controller 110 combining the data to calculate an amount.

The controller 110 may use data from the memory to determine a quality of the print fluid. For example, the print fluid in the print fluid supply may become depleted over time. Water may evaporate and escape the print fluid supply, leaving behind a thicker print fluid that may cause printing issues. The print fluid may be depleted of substances other than water. Substances in the print fluid may harden and attach to the surface of the print fluid supply or clump together. The rate at which water and other substances are depleted from the print fluid may vary over time due to various conditions such as heat, humidity, size of the print fluid supply, type of print fluid, and the amount of print fluid in the print fluid supply. The controller 110 may calculate an expected depletion based on the amount of print fluid in the print fluid supply over the amount of time between additions or removals of print fluid. For example, the controller 110 may calculate that 0.1% of the water is depleted from the print fluid in the two weeks between the manufacture of the print fluid supply and the first use. Based on the amount remaining in the print fluid supply after the first use, a three-month period of time before the second use, and the prior depletion, the controller 110 may calculate that 0.8% of the water is depleted at the time of the second use. These percentages of depletion are merely examples.

The controller 110 may determine that the print fluid quality is within the tolerances for use with the printer 100. In response to that determination, the controller 110 may activate the actuator 150 to allow print fluid to flow from the external print fluid supply through the fluid conduit 140 into the print fluid reservoir 130. The controller 110 may keep track of how much print fluid is removed from the print fluid supply and write that value to the memory. The controller 110 may write a time of removal to the memory and associate the time with the amount of print fluid removed. The controller 110 may write a printer identification into the memory and associate the printer identification with the time and amount of print fluid removed. If issues with the print fluid in the print fluid supply are discovered, this may allow a record of which printers used the print fluid. The printers may thus be appropriately serviced. The print fluid may also be located and disposed of. The printer may check identification information from the memory against a record of print fluid supplies identified as causing issues and prevent refilling the print fluid reservoir from such print fluid supplies.

In various examples, addition of print fluid to the print fluid supply may alter the depletion amount. Addition of fresh print fluid may reduce the depletion amount, as the fresh print fluid has not yet been as depleted as the print fluid in the print fluid supply. Information regarding the time and date of the addition of print fluid to the print fluid supply may be recorded in the memory. Information about a print fluid quality may be recorded in the memory. Print fluid from another print fluid supply may be added, and the other print fluid supply may have a different depletion level. Information may be written into the memory from the memory on the other print fluid supply to enable a determination of print fluid quality. The information from the other print fluid supply may be aggregated at the time of transfer and it may be aggregated with information already in the memory to provide an estimated depletion amount at the time of transfer. The controller 110 may base print fluid quality estimates of changes to that depletion amount based on subsequent addition and removal of print fluid.

In various examples, substances other than print fluid may be added to the print fluid supply. For example, water and other substances may be added to the print fluid supply if the print fluid supply is determined to be depleted past a predetermined amount. The addition of water or other substances may improve the print fluid quality. Addition of these substances and the respective time may be recorded in the memory on the print fluid supply.

In various examples, the memory may include a unique identifier for the print fluid supply. The data regarding the use of the print fluid supply may be stored on a data store accessible over a network. Instead of reading data about use of the print fluid supply from the memory, the controller 110 may read the unique identifier from the memory. The controller 110 may use the unique identifier to access the data store over the network and retrieve the print fluid supply usage data from the data store. The controller 110 may write data regarding the removal of print fluid from the print fluid supply to the data store.

Figure 2:
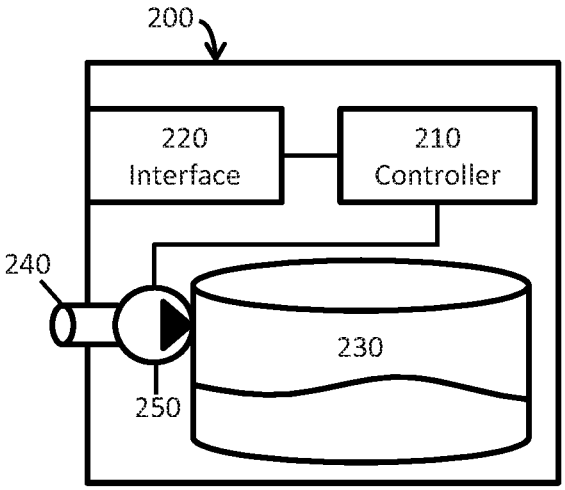
FIG. 2 depicts a printer with an interface and a pump in accordance with various examples.

FIG. 2 shows a printer 200 with an interface 220 and a pump 250 in accordance with various examples. The printer 200 may include a controller 210, an interface 220, a print fluid input port 240, a pump 250, and a print fluid reservoir 230. The controller 210 may be coupled to the interface 220, such as via a bus. The controller 210 may be coupled to the pump 250, such as via a bus or a control line.

The print fluid reservoir 230 of the printer 200 may be refillable from an external print fluid supply. The print fluid supply may couple to the interface 220 and the print fluid input port 240. The print fluid supply may include a memory that interfaces with the interface 220. The print fluid supply may include mechanical guides to assist in lining up the memory with the interface 220 and to line up the print fluid supply with the print fluid input port 240. A seal may be formed between the print fluid input port 240 and the print fluid supply.

In various examples, the print fluid supply may include a cap that is removed to provide access to the print fluid. The print fluid input port 240 may include a tube that is placed into the print fluid supply. The pump 250 may pump print fluid from the print fluid supply through print fluid input port 240 and into the print fluid reservoir 230.

In various examples, the print fluid input port 240 may be part of the interface 220 or couple to the print fluid supply through the interface 220. The print fluid input port 240 may include a needle to puncture a resealable membrane on the print fluid supply. The print fluid supply may include a cap or cover for the resealable membrane to prevent unintentional puncturing while not in use. The cap may mechanically block the print fluid supply from interfacing with the printer 200 to prevent unintentional damage to the needle. The needle may be retracted while not in use to prevent unintentional injury to users. The printer 200 may include an actuator to position the needle in the resealable membrane. The actuator may be activated once the controller 210 accesses the memory and determines that the print fluid is to be pumped from the print fluid supply to the print fluid reservoir 230. The printer 200 may include a mechanical system to automatically move the needle to puncture the resealable membrane, such as a spring-based or lever-based system that activates by the physical interfacing of the printer 200 and the print fluid supply via the interface 220. The controller 210 may control the pump 250 to prevent the flow of print fluid through the print fluid input port 240 until the controller 210 has determined the print fluid is to be pumped from the print fluid supply to the print fluid reservoir 230.

In various examples, the controller 210 may analyze data stored on the memory of the print fluid supply or in a network storage indexed by an identifier stored in the memory. The controller 210 may analyze the data to determine a print fluid quality of the print fluid in the print fluid supply. Based on the print fluid quality, the controller 210 may control the pump 250 to transfer print fluid from the print fluid supply to the print fluid reservoir 230. If the print fluid quality indicates the print fluid may be too depleted to use without affecting quality of printing or without potentially damaging the printer 200, the controller 210 may prevent the transfer of print fluid and provide a warning for a user. The warning may also be logged in an event log for the printer 200 or sent to a systems administrator.

In various examples, the controller 210 may consider the status of the print fluid reservoir, such as the quality and quantity of print fluid currently in the print fluid reservoir 230 in determining whether to transfer print fluid from the print fluid supply to the print fluid reservoir 230. For example, the print fluid supply may be too depleted to use on its own, but just barely so. The combination of print fluid from the print fluid supply with the existing print fluid in the print fluid reservoir 230 may still be within tolerances of the printer 200. The controller 210 may determine that a full refill of the print fluid reservoir 230 from the print fluid supply may result in print fluid that is too depleted, but that a partial refill would result with print fluid within the tolerances of the printer 200. The controller 210 may control the pump 250 to pump a partial refill of print fluid from the print fluid supply into the print fluid reservoir 230.

In various examples, when the controller 210 determines there are quality issues with a print fluid supply, the controller 210 may provide a warning. The warning may be displayed by the printer 200. The warning may be entered into an event log of the printer 200 or another event log for use by systems administrators. The warning may allow personnel to dispose of the print fluid supply or solve the print fluid quality issues, such as introducing water or other substances to the print fluid supply.

In various examples, the controller 210 may allow a user to override a warning and force the refilling of the print fluid reservoir 230 from a print fluid supply with print fluid quality issues. The controller 210 may log the use of an override command, such as in the event log of the printer 200 or in a maintenance log. The log of an override command may be used in diagnosing printer errors in the future. If the print fluid quality causes issues, the log may be useful in identifying the print fluid as the issue and speed up repairs or maintenance of the printer 200.

Figure 3:
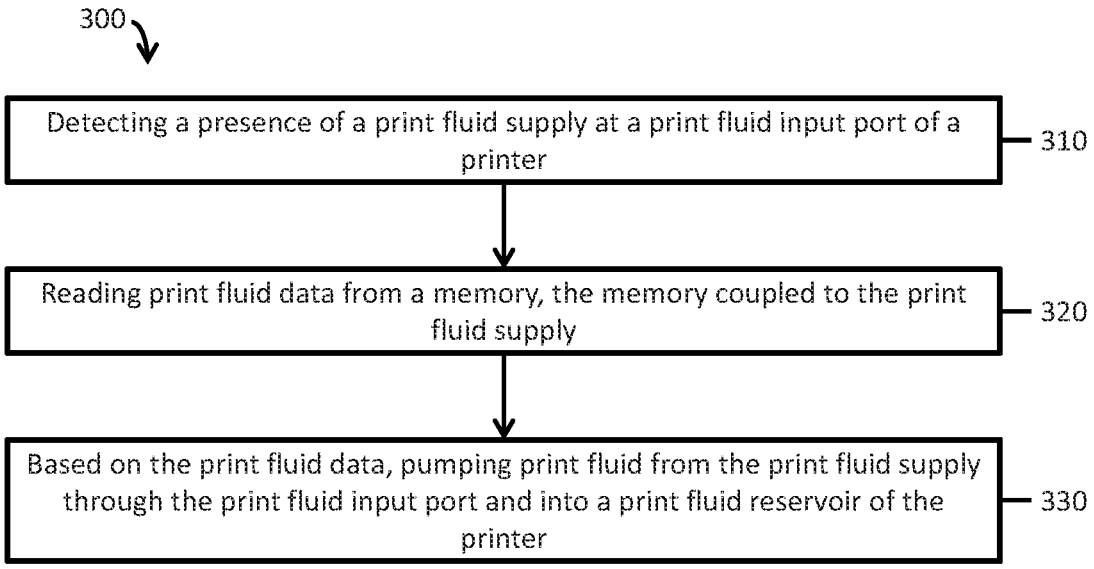
FIG. 3 depicts a method of detecting a print fluid supply and pumping print fluid from the print fluid supply in accordance with various examples.

FIG. 3 shows a method 300 of detecting a print fluid supply and pumping print fluid from the print fluid supply in accordance with various examples. The method 300 includes detecting a presence of a print fluid supply at a print fluid input port of a printer (310). The method 300 includes reading print fluid data from a memory, the memory coupled to the print fluid supply (320). The method 300 includes based on the print fluid data, pumping print fluid from the print fluid supply through the print fluid input port and into a print fluid reservoir of the printer (330).

Detecting the presence of the print fluid supply at the print fluid input port of the printer may include reading data from the memory. If print fluid supplies have memory, the absence of a memory at an electrical interface may indicate the absence of a print fluid supply at the print fluid input port. Detecting the presence of the print fluid supply may include a mechanical interaction, such as pressing of buttons when the print fluid supply is present. The buttons may activate an electrical signal indicating a print fluid supply is present. In various examples, the printer may detect the activation of the mechanical device, and then try reading from a memory. If the mechanical device is activated and the memory is present and readable, the print fluid supply may be considered detected.

In various examples, the print fluid data may include an indication of the print fluid quality, volume of remaining print fluid, and date of last access to the print fluid supply. From such data, the printer may determine a current print fluid quality. The printer may update the print fluid data on the memory following removal of print fluid from the print fluid supply or on determining there is an issue with the print fluid quality.

In various examples, the printer may store a value for the print fluid quality in a data log. The printer may also store an association between the value and the printer. This data may be stored when there is a print fluid quality issue, but the print fluid is still used to refill the printer's print fluid reservoir. This data may be stored regardless of the print fluid quality. For example, the data may be stored along with a volume of print fluid used to refill the printer's print fluid reservoir and the time or date. This may be used to identify high-usage printers for service and maintenance or when adding additional printers for use.

Figure 4:
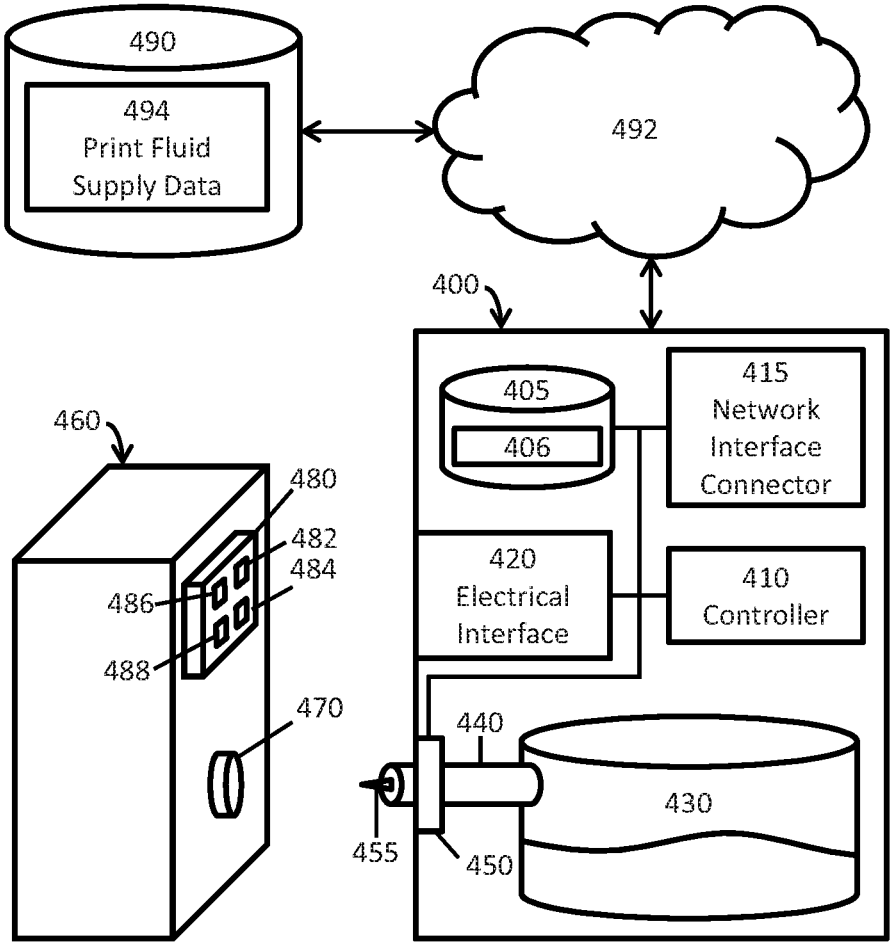
FIG. 4 depicts a printer, print fluid supply, and data store in accordance with various examples.

FIG. 4 depicts a printer 400, print fluid supply 460, and data store 490 in accordance with various examples. Printer 400 includes storage 405, a controller 410, a network interface connector 415, an electrical interface 420, a print fluid reservoir 430, a fluid conduit 440, an actuator 450, and a needle 455. The storage 405, controller 410, network interface connector 415, electrical interface 420, and actuator 450 may be coupled together, such as via a bus. The actuator 450 may be coupled to the needle 455 to allow for extending and retracting the needle 455. The storage 405 may include an event log 406 to store events that occur with the printer. The events may include maintenance records, warnings and errors that occur with the printer 400, when the printer 400 is turned on or off, and data regarding the print fluid used by the printer 400.

Printer 400 may communicate with data store 490 over a network 492. The network 492 may include a local area network (LAN) a wide area network (WAN) a public network, or a private network. The network may provide access to the Internet. Data store may store print fluid supply data 494.

Print fluid supply 460 includes a memory 480 and a septum 470. The memory 480 stores data, such as an identifier 482, an indication of an amount 484 of print fluid in the print fluid supply 460, a time 486 of an access to the print fluid reservoir 430, and a quantity 488 of print fluid transferred from the print fluid supply 460. The time 486 of an access may include times 486 of access to print fluid reservoirs 430 of different printers 400, such as when a print fluid supply 460 is used to refill multiple printers 400. The quantity 488 of print fluid transferred may include values for multiple instances of print fluid transfer. A particular quantity 488 may be associated with a particular time 486 of access when the particular quantity 488 was transferred.

The memory 480 may interface with the electrical interface 420. The memory 480 may hold data used by the controller 410 to determine whether to use the print fluid from the print fluid supply 460. The data used by the controller 410 may include the indication of an amount 484 of print fluid in the print fluid supply 460, times 486 of access and quantities 488 transferred.

In various examples, the memory 480 may store an identifier 482. The controller 410 may use the identifier to retrieve print fluid supply data 494 from the data store 490 across the network 492. The print fluid supply data 494 may store data regarding use of the print fluid supply, such as records of the amount of print fluid in the print fluid supply 460, times of access, and quantities of print fluid transferred. The data store 490 or memory 480 may store a printer identification associated with a time of access.

In various examples, the controller 410 may determine that the print fluid supply 460 is to be used to refill the print fluid reservoir 430. The controller 410 may activate the actuator 450 to extend the needle 455 and puncture the septum 470. The needle 455 may be hollow to allow flow of print fluid through the needle 455 and into the fluid conduit. A pump may be used to transfer the print fluid. Once the transfer of print fluid is completed, the controller 410 may control the actuator 450 to retract the needle 455. The septum 470 may seal itself with retraction of the needle 455.

In various examples, storing print fluid supply data 494 on a data store 490 accessible across the network 492 may allow a fleet management system to track the status of print fluid supplies 460 across a fleet of printers 400. The fleet management system may determine that a print fluid supply 460 is low or has become too depleted for further use. The fleet management system may reference a printer identifier stored in the print fluid supply data 494 to identify a location where the print fluid supply 460 may be physically stored. The fleet management system may cause the replacement of the print fluid supply 460, such as through a service call by a technician. The fleet management system may cause a replacement print fluid supply 460 to be shipped to the location prior to the existing print fluid supply 460 becoming empty or too depleted. This may ensure any printers 400 routinely refilled from the print fluid supply 460 are kept in operation. The fleet management system may analyze records of past use of the print fluid supply 460 stored in the print fluid supply data 494 to determine a print fluid use rate in determining when to replace the print fluid supply 460.

Tracking the quantity and quality of print fluid in print fluid supplies, rate of print fluid use by printers, printers refilled from the print fluid supplies, and related data may enhance capabilities of a fleet management system. Printers may be offline less often due to lack of print fluid or use of depleted print fluid. Maintenance issues with printers may be more readily resolved.

The above discussion is meant to be illustrative of the principles and various examples of the present disclosure. Numerous variations and modifications will become apparent to those skilled in the art once the above disclosure is fully appreciated. It is intended that the following claims be interpreted to embrace all such variations and modifications.

What is claimed is:

1. An apparatus comprising:

an electrical interface to access a memory, the memory being external to the apparatus;

a print fluid reservoir;

a fluid conduit to connect the print fluid reservoir with a print fluid supply, the print fluid supply being external to the apparatus;

an actuator to selectively allow fluid flow through the fluid conduit from the print fluid supply; and a controller coupled to the electrical interface, the controller to determine a print fluid quality based on data receivable from the memory via the electrical interface, and the controller to control the actuator based on the print fluid quality.

2. The apparatus of claim 1, wherein the data receivable from the memory includes an identifier, and wherein the controller is to access a data store based on the identifier, the data store including information regarding a use of the print fluid supply.

3. The apparatus of claim 2, wherein the data store is accessible by the controller via a network interface connector.

4. The apparatus of claim 1, wherein the data receivable from the memory includes an indication of an amount of print fluid in the print fluid supply.

5. The apparatus of claim 4, wherein the controller is to cause a time of an access to the print fluid reservoir to be stored in the memory.

6. An apparatus comprising:

a print fluid reservoir;

a print fluid input port to receive print fluid from a print fluid supply, the print fluid supply being external to the apparatus;

a pump coupled to the print fluid reservoir and the print fluid input port, the pump to pump print fluid from the print fluid supply into the print fluid reservoir;

an interface to access a memory, the memory being external to the apparatus and coupled to the print fluid supply; and a controller to determine a print fluid quality based on data receivable from the memory via the interface, and the controller to control the pump.

7. The apparatus of claim 6, wherein the controller is to control the pump based on the print fluid quality.

8. The apparatus of claim 7, wherein the controller is to control the pump based on a status of the print fluid reservoir.

9. The apparatus of claim 6, wherein the controller is to receive an override command and control the pump based on the override command.

10. The apparatus of claim 9, wherein the controller is to store data in an event log based on the override command.

11. A method comprising:

detecting a presence of a print fluid supply at a print fluid input port of a printer;

reading print fluid data from a memory, the memory coupled to the print fluid supply; and based on the print fluid data, pumping print fluid from the print fluid supply through the print fluid input port and into a print fluid reservoir of the printer.

12. The method of claim 11, wherein the detecting includes the printer reading data from the memory via an electrical interface.

13. The method of claim 11 comprising:

determining a print fluid quality of the print fluid based on the print fluid data; and providing a warning based on the print fluid quality.

14. The method of claim 13 comprising storing a value for the print fluid quality and storing an association between the value and the printer.

15. The method of claim 11 comprising writing data into the memory, the data including a quantity of print fluid pumped from the print fluid supply and a time the pumping occurred.

* * * * *